US009140034B2

(12) United States Patent
Ben-Aharon

(10) Patent No.: US 9,140,034 B2
(45) Date of Patent: Sep. 22, 2015

(54) LOCK ASSEMBLY WITH MOVABLE ELEMENT

(75) Inventor: Effi Ben-Aharon, Hod HaSharon (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 4 days.

(21) Appl. No.: 13/983,569

(22) PCT Filed: Mar. 11, 2012

(86) PCT No.: PCT/US2012/028669

§ 371 (c)(1),
(2), (4) Date: Aug. 4, 2013

(87) PCT Pub. No.: WO2012/125512

PCT Pub. Date: Sep. 20, 2012

(65) Prior Publication Data

US 2013/0327102 A1 Dec. 12, 2013

(30) Foreign Application Priority Data

Mar. 13, 2011 (IL) ..... 211697

(51) Int. Cl.

*E05B 27/08* (2006.01)
*E05B 35/00* (2006.01)
*E05B 27/00* (2006.01)

(52) U.S. Cl.

CPC ..... *E05B 27/08* (2013.01); *E05B 27/0042* (2013.01); *E05B 35/003* (2013.01); *E05B 27/0021* (2013.01); *Y10T 70/7605* (2015.04)

(58) Field of Classification Search

CPC E05B 35/003; E05B 27/0021; E05B 27/0042
USPC ..... 70/395–412, 414, 490–496
See application file for complete search history.

(56) References Cited

U.S. PATENT DOCUMENTS 2,049,548 A * 8/1936 Swanson ..... 70/493
4,078,406 A * 3/1978 Genakis ..... 70/493
4,098,103 A * 7/1978 Raskevicius ..... 70/494

(Continued)

FOREIGN PATENT DOCUMENTS

AT 395262 11/1992
DE 3626553 2/1988

(Continued)

OTHER PUBLICATIONS

PCT Written Opinion PCT/US2012/028669, Sep. 4, 2012.

*Primary Examiner* — Peter M Cuomo
*Assistant Examiner* — Ifeolu Adeboyejo
(74) *Attorney, Agent, or Firm* — Dekel Patent Ltd.; David Klein

(57) ABSTRACT

A lock assembly (10) including a plug (12) having a keyway (14) for inserting therein a key (16), the plug (12) arranged for movement in a bore (18) formed in a lock body (20) along a shear line (24) defined between an outer perimeter of the plug (12) and an inner perimeter of the bore (18), and at least one movable element (26, 28) slidingly disposed in an opening formed in the plug (12), wherein insertion of the key in the keyway (14) without movement of the plug (12) in the lock body (20) does not align the at least one movable element (26, 28) with the shear line (24), but movement of the plug (12) in the lock body (20) with the key (16) inserted in the keyway (14) aligns the at least one movable element (26, 28) with the shear line (24).

8 Claims, 8 Drawing Sheets

(56) References Cited

U.S. PATENT DOCUMENTS

| | | | | | |
|---|---|---|---|---|---|
| 4,213,316 | A | * | 7/1980 | Tietz | 70/358 |
| 4,325,242 | A | * | 4/1982 | Tietz | 70/401 |
| 4,377,082 | A | * | 3/1983 | Wolter | 70/493 |
| 4,434,636 | A | * | 3/1984 | Prunbauer | 70/358 |
| 4,638,651 | A | * | 1/1987 | Surko, Jr. | 70/495 |
| 4,667,495 | A | * | 5/1987 | Girard et al. | 70/398 |
| 4,753,091 | A | * | 6/1988 | Sheets | 70/493 |
| 4,905,489 | A | * | 3/1990 | Keller | 70/378 |
| 5,010,753 | A | * | 4/1991 | Boris, Jr. | 70/371 |
| 5,050,412 | A | * | 9/1991 | Errani | 70/358 |
| 5,123,268 | A | * | 6/1992 | Eizen | 70/359 |
| 5,131,249 | A | * | 7/1992 | Baden et al. | 70/398 |
| 5,437,176 | A | * | 8/1995 | Keller | 70/358 |
| 5,438,857 | A | * | 8/1995 | Kleinhaeny | 70/493 |
| 5,457,974 | A | * | 10/1995 | Keller | 70/358 |
| 5,520,035 | A | * | 5/1996 | Eizen et al. | 70/358 |
| 5,531,084 | A | * | 7/1996 | Laabs et al. | 70/409 |
| 5,533,369 | A | * | 7/1996 | Valdajos-Gallego | 70/493 |
| RE35,518 | E | * | 5/1997 | Sussina | 70/369 |
| 5,784,910 | A | * | 7/1998 | Eizen et al. | 70/395 |
| 5,823,030 | A | * | 10/1998 | Theriault et al. | 70/419 |
| 5,839,308 | A | * | 11/1998 | Eizen et al. | 70/358 |
| 6,125,674 | A | * | 10/2000 | Aramburu | 70/358 |
| 6,257,033 | B1 | * | 7/2001 | Ziv-Av | 70/494 |
| 6,490,898 | B1 | * | 12/2002 | Mottura | 70/495 |
| 6,508,091 | B1 | * | 1/2003 | Donatini | 70/359 |
| 6,983,630 | B2 | * | 1/2006 | Eden et al. | 70/493 |
| 7,421,869 | B2 | * | 9/2008 | Osada | 70/358 |
| 7,647,799 | B2 | * | 1/2010 | Markbreit et al. | 70/409 |
| 7,810,365 | B2 | * | 10/2010 | Villani | 70/419 |
| 8,336,350 | B2 | * | 12/2012 | Nicoara | 70/395 |
| 2008/0236223 | A1 | * | 10/2008 | Markbreit et al. | 70/358 |
| 2011/0072867 | A1 | * | 3/2011 | Haviv et al. | 70/357 |

FOREIGN PATENT DOCUMENTS

| | | |
|---|---|---|
| WO | 00/22263 | 4/2000 |
| WO | 2005/014961 | 2/2005 |
| WO | 2010/027760 | 3/2010 |

* cited by examiner

LOCK ASSEMBLY WITH MOVABLE ELEMENT

FIELD OF THE INVENTION

The present invention relates to locking apparatus generally and more particularly to a lock assembly with a movable element that aligns with a shear line only upon movement of a plug in a lock body.

BACKGROUND OF THE INVENTION

As is well known in the art, cylinder locks generally include a plug (also called tumbler) arranged for rotation in a cylinder lock housing. Plug pins are slidingly disposed in the plug and are arranged to move against driver pins, which are disposed in bores formed in the cylinder lock housing and are spring biased toward the axis of the plug rotation. Insertion of a properly cut key in a keyway provided in the plug moves the plug pins against the driver pins and aligns all the pins along a shear line defined by the plug outer circumference, thereby permitting rotation of the plug to cause operation of a latch or locking mechanism.

In the prior art, insertion of the key brings all the plug pins to the shear line before rotation of the plug.

SUMMARY OF THE INVENTION

The present invention seeks to provide a novel lock assembly with a movable element that aligns with the shear line only upon movement of the plug in the lock body, as is described more in detail hereinbelow.

There is thus provided in accordance with an embodiment of the present invention a lock assembly including a plug having a keyway for inserting therein a key, the plug arranged for movement in a bore formed in a lock body along a shear line defined between an outer perimeter of the plug and an inner perimeter of the bore, and at least one movable element slidingly disposed in an opening formed in the plug, wherein insertion of the key in the keyway without movement of the plug in the lock body does not align the at least one movable element with the shear line, but movement of the plug in the lock body (for example, rotation of the plug about a rotation axis) with the key inserted in the keyway aligns the at least one movable element with the shear line.

There is also provided in accordance with an embodiment of the present invention a lock assembly including a key including a shaft portion and at least one movable key combination element retained within the shaft portion, and a plug having a keyway for inserting therein the key, the plug arranged for movement in a bore formed in a lock body along a shear line defined between an outer perimeter of the plug and an inner perimeter of the bore, wherein when the key is fully inserted in the keyway, the at least one movable key combination element protrudes beyond an outer surface of the shaft portion only upon movement of the plug in the lock body.

Non-limiting embodiments of the invention include one or more of the following features.

The at least one movable element includes first and second movable elements located in openings formed in the plug on opposite sides of the keyway. The first and second movable elements may be shaped differently.

The lock assembly also includes at least one plug pin slidingly disposed in a plug bore formed in the plug, wherein insertion of the key in the keyway without movement of the plug in the lock body aligns the at least one plug pin with the shear line.

The at least one movable element does not have to be spring-loaded or biased in the plug.

A portion of the at least one movable element is received in a recess formed in the lock body and moves out of the recess upon the movement of the plug in the lock body. The recess is relatively wide facing the plug and tapers to a narrower width in a direction away from the plug, the portion of the at least one movable element having a complementary-tapered shape to fit in the recess. The at least one movable element includes a base and a protrusion protruding from the base towards the shear line, and wherein a centerline of the base is offset from a centerline of the plug.

The opening in which the second movable element is disposed is formed with a counterbore facing the shear line and opposite to the recess.

The key includes a shaft portion and at least one movable key combination element retained within the shaft portion, the at least one movable element touching the at least one movable key combination element when the key is inserted in the keyway.

The first and second movable elements touch opposite sides of the at least one movable key combination element when the key is inserted in the keyway.

The second movable element is arranged to move against a driver pin slidingly disposed in the lock body. The driver pin applies a biasing force towards the second movable element. The driver pin extends into the counterbore when the key is inserted in the keyway before the plug moves in the lock body. Upon the movement of the plug in the lock body, the first movable element moves against the at least one movable key combination element, which moves against the second movable element, which moves against the driver pin, overcoming the biasing force and causing the driver pin to move out of the counterbore to permit rotation.

BRIEF DESCRIPTION OF THE DRAWINGS

The present invention will be understood and appreciated more fully from the following detailed description, taken in conjunction with the drawings in which:

FIGS. 2-5 are simplified sectional illustrations of the lock assembly of FIG. 1, taken along lines A-A in FIG. 1, wherein:

FIG. 2 illustrates the lock assembly with no key inserted in the keyway of the plug;

FIG. 3 illustrates the lock assembly with a key inserted in the keyway, before moving (e.g., rotating) the plug;

FIG. 4 illustrates initial movement (e.g., rotation) of the plug, wherein a first movable element on one side of the key starts to move out of a recess formed in the lock body and a second movable element on the other side of the key depresses a driver pin;

FIG. 5 illustrates further movement (e.g., rotation) of the plug, wherein the first movable element has moved along the shear line away from the recess and the second movable element has moved along the shear line away from the driver pin;

DETAILED DESCRIPTION OF EMBODIMENTS

Figure 1:
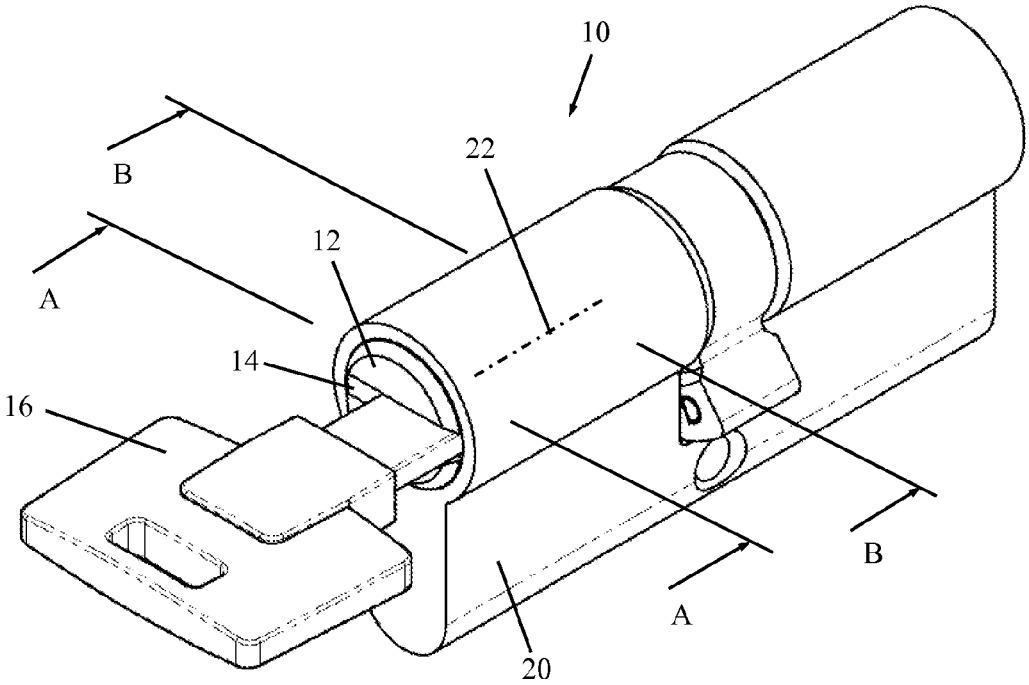
FIG. 1 is a simplified pictorial illustration of a lock assembly, constructed and operative in accordance with an embodiment of the present invention.
Figure 2:
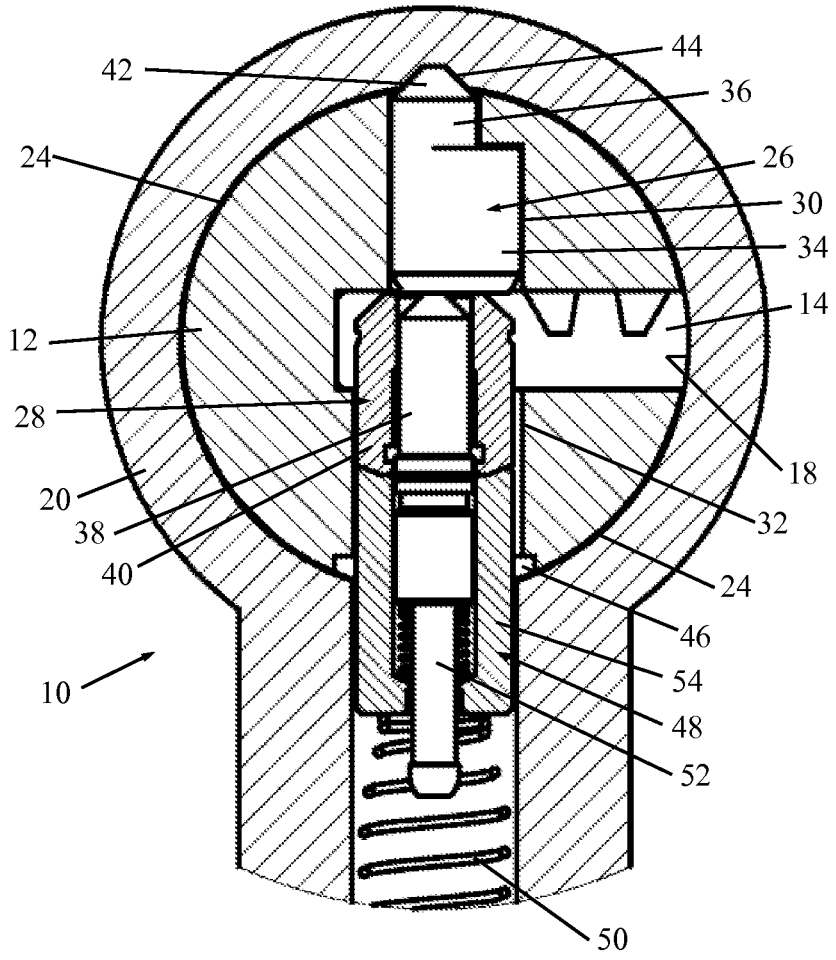

Reference is now made to FIGS. 1 and 2, which illustrates a lock assembly 10, constructed and operative in accordance with a non-limiting embodiment of the present invention.

In the illustrated embodiment, lock assembly 10 includes a plug 12 having a keyway 14 for inserting therein a key 16 (not shown in FIG. 2). Plug 12 is arranged for movement in a bore 18 formed in a lock body 20. In the illustrated embodiment, the movement of the plug 12 is rotation about a rotation axis 22, which is the longitudinal central axis of the plug (FIG. 1). However, the invention is not limited to rotation, and the invention can be carried out with a plug that moves linearly in a lock body, for example. In the illustrated embodiment, lock body 20 is a European profile cylinder lock body, but the invention is not limited to such a lock body. A shear line 24 is defined between an outer perimeter of plug 12 and an inner perimeter of bore 18.

Figure 8:
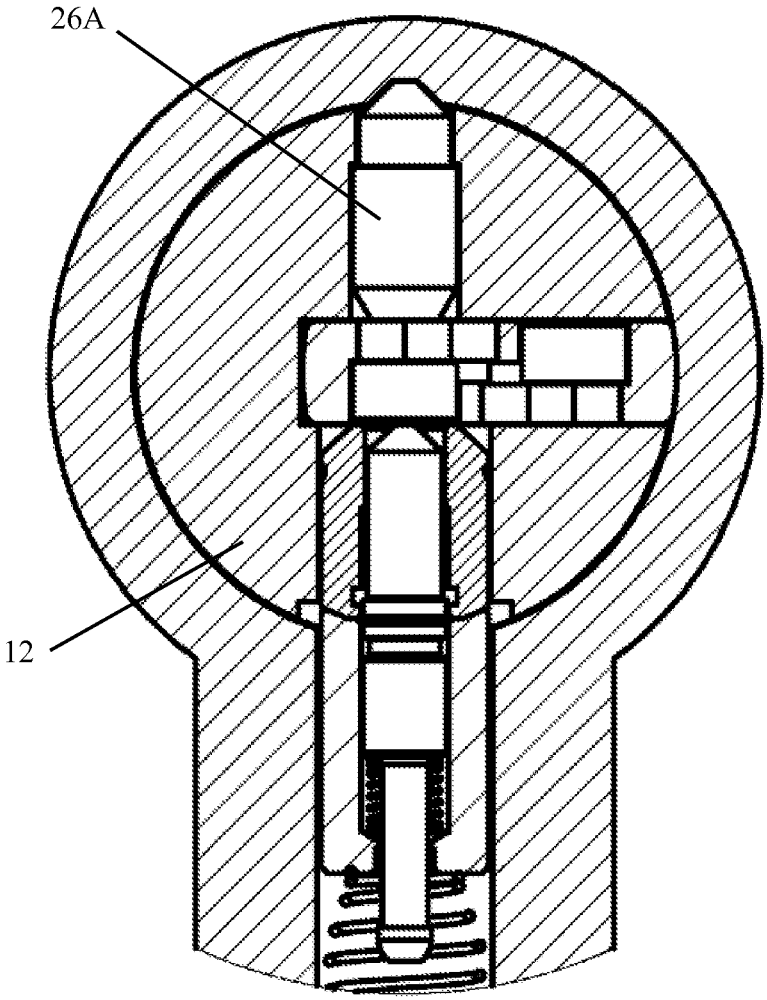
FIG. 8 is a simplified sectional illustration of a different embodiment of the lock assembly, in which the movable element is not offset from the centerline of the plug.

One or more movable elements are slidingly disposed in openings formed in plug 12. In the illustrated embodiment, there is a first movable element 26 and a second movable element 28 located in openings 30 and 32, respectively, formed in plug 12 on opposite sides of keyway 14. The first and second movable elements 26 and 28 may be shaped differently. For example, the first movable element 26 includes a base 34 and a protrusion 36 protruding from base 34 towards shear line 24, and the centerline of base 34 is offset from the centerline of plug 12. (FIG. 8 illustrates a different embodiment, in which a first movable element 26A is not offset from the centerline of plug 12.) The second movable element 28 may be a multiple pin or telescoping pin element, having an inner pin 38 and an outer pin 40. A portion 42 of the first movable element 26 may be initially received in a recess 44 formed in lock body 20. Recess 44 is relatively wide facing plug 12 and tapers to a narrower width in a direction away from plug 12. Portion 42 has a complementary-tapered shape to fit in recess 44. The opening 32, in which second movable element 28 is disposed, is formed with a counterbore 46 facing the shear line 24 and opposite to recess 44.

It is noted that the movable elements 26 and 28 are not spring-loaded or biased (although in alternative embodiments, at least one of them may be). It is also noted that the movable elements 26 and 28 are shown as moving perpendicular to the key, but alternatively they can move at other angles as well, and different from each other.

Lock assembly 10 also includes one or more driver pins 48 slidingly disposed in lock body 20. Driver pin 48 applies a biasing force towards second movable element 28, such as by means of a spring 50 (or magnet or other biasing device). Driver pin 48 may be a multiple pin or telescoping pin element, having an inner pin 52 and an outer pin 54.

In the position shown in FIG. 2, with no key inserted, driver pin 48 pushes against second movable element 28, which in turn pushes against first movable element 26, thereby forcing portion 42 into recess 44.

Figure 3:
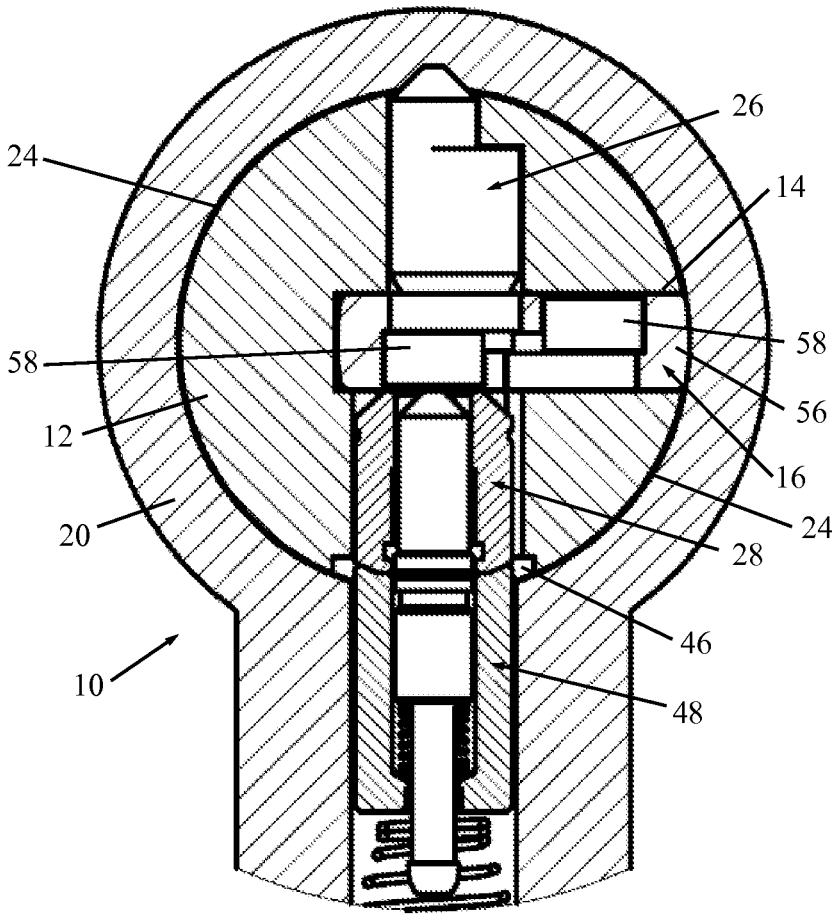
Figure 6:
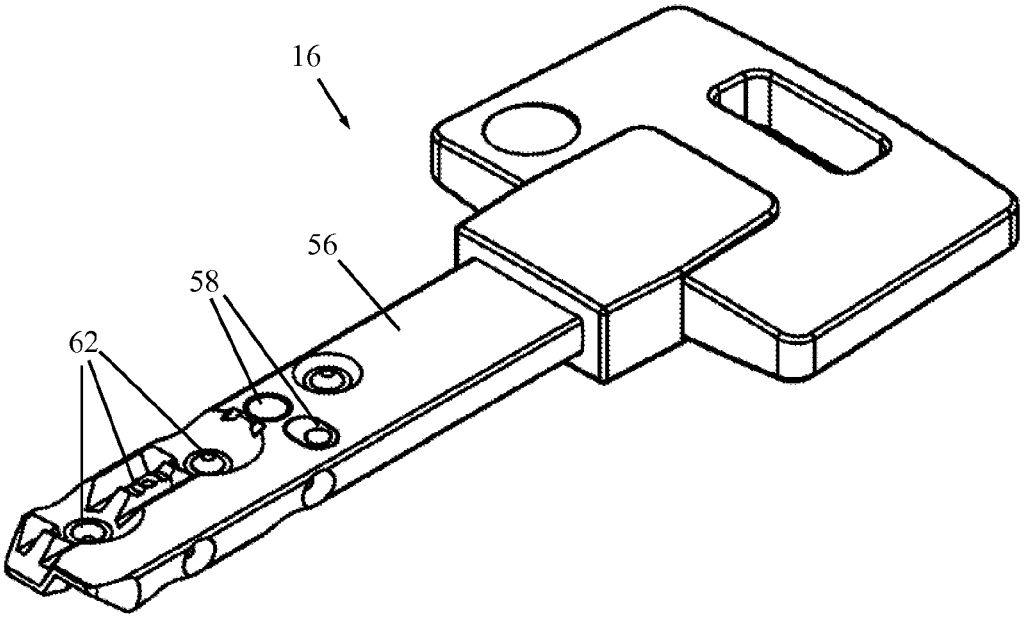
FIG. 6 is a simplified pictorial illustration of a key used with the lock assembly of the present invention.

Reference is now made to FIG. 3, which illustrates key 16 inserted in keyway 14, before moving (e.g., rotating) plug 12. Key 16, also shown in FIG. 6, may be, but not necessarily, constructed similarly to the key device of PCT application PCT/US2009/054835 (published as WO 2010/27760). Key 16 includes a shaft portion 56 and one or more movable key combination elements 58 retained within shaft portion 56. As seen in FIG. 3, the movable elements 26 and 28 touch the movable key combination element 58 (or in the illustrated embodiment, one of them) when key 16 is inserted in keyway 14.

Figure 7:
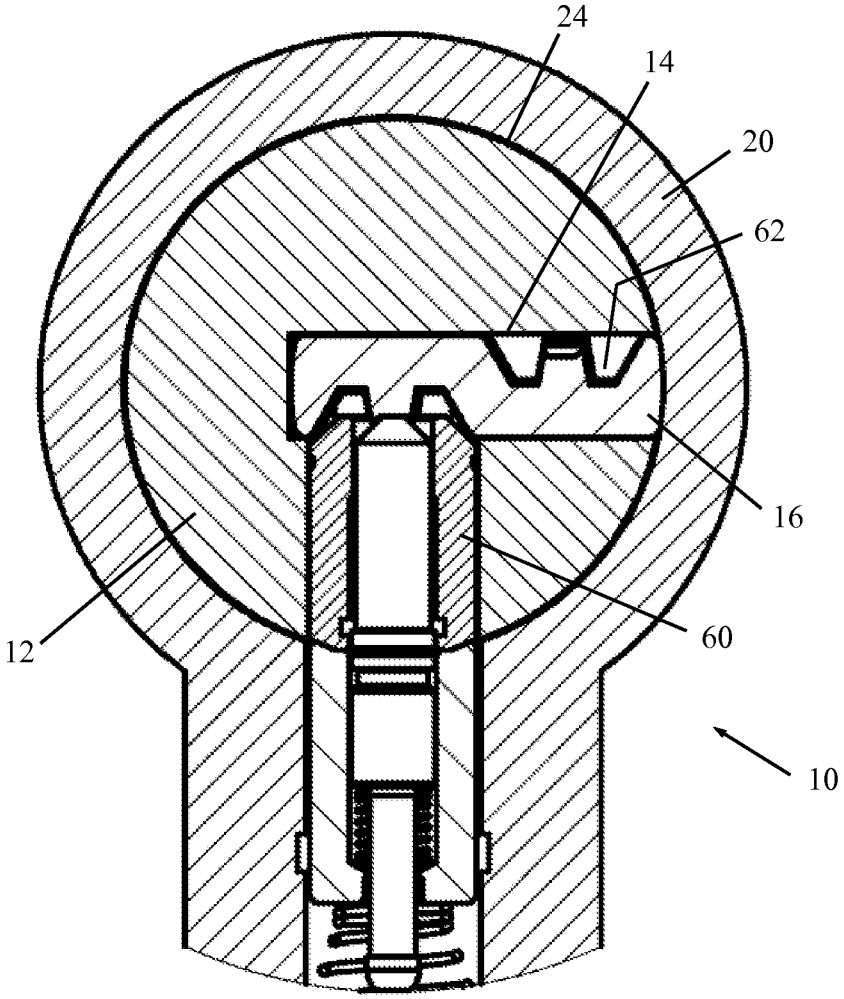
FIG. 7 is a simplified sectional illustration of the key inserted in the lock assembly at a different section of the lock assembly, taken along lines B-B in FIG. 1, wherein in accordance with an embodiment of the present invention, another plug pin aligns with the shear line upon insertion of the key in the keyway without movement of the plug in the lock body.

Key 16, with its one or more movable key combination elements 58, will eventually align the movable elements with the shear line upon movement of the plug, as is explained below. In addition, as seen in FIG. 7, the lock assembly 10 may include one or more plug pins 60 (at different longitudinal positions in the plug 12), and key 16 may be formed with one or more key cuts 62 (FIG. 6) that align plug pin 60 with the shear line 24 upon insertion in keyway 14 without movement of plug 12 in lock body 20.

However, referring again to FIG. 3, it is seen that insertion of key 16 in keyway 14 without movement of plug 12 in lock body 20 does not align the movable elements 26 and 28 with the shear line 24. The driver pin 48 extends into counterbore 46 when key 16 is inserted in keyway 14 before plug 12 moves in lock body 20.

Figure 4:
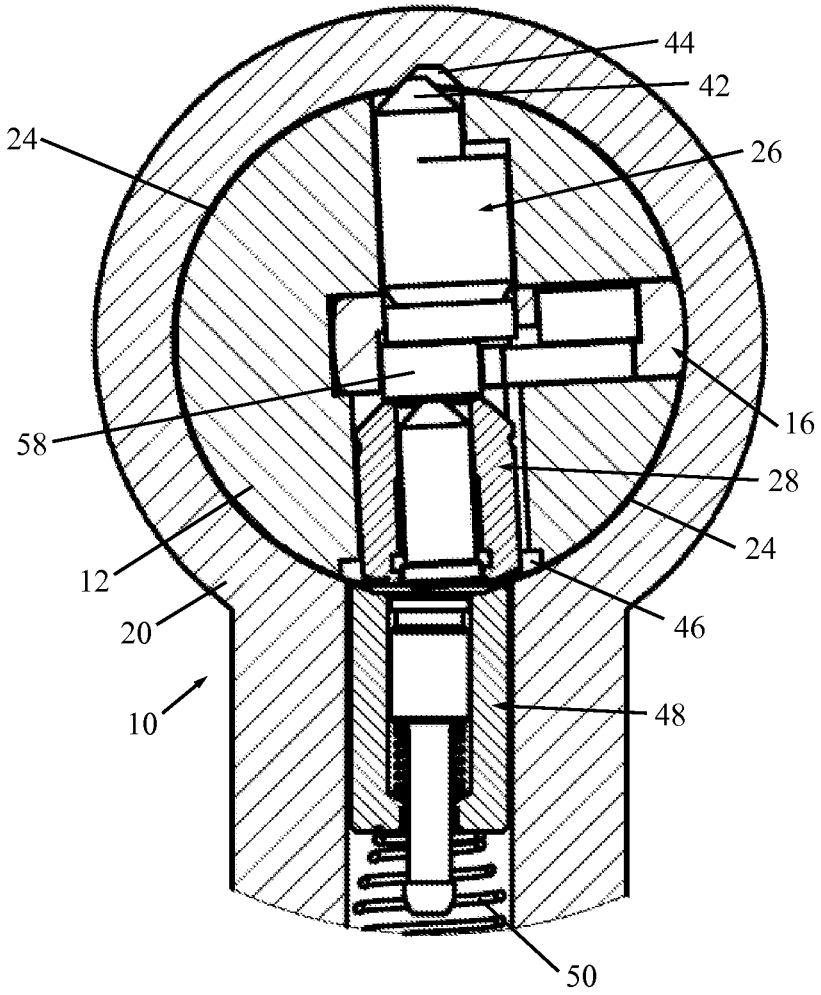

Reference is now made to FIG. 4, which illustrates initial movement (e.g., rotation) of plug 12. Portion 42 of first movable element 26 starts to move out of recess 44 and second movable element 28 depresses driver pin 48. Accordingly, upon movement of plug 12 in lock body 20, first movable element 26 moves against movable key combination element 58, which moves against second movable element 28, which moves against driver pin 48, overcoming the biasing force of spring 50 and causing driver pin 48 to move out of counterbore 46 to permit rotation of plug 12.

It is noted that the chamfered shape of the portion 42 allows it to move out of the tapered shape of recess 44. It is further noted that if there were no counterbore 46, driver pin 48 would abut against the wall of opening 32 and it would not be possible to rotate plug 12.

Figure 5:
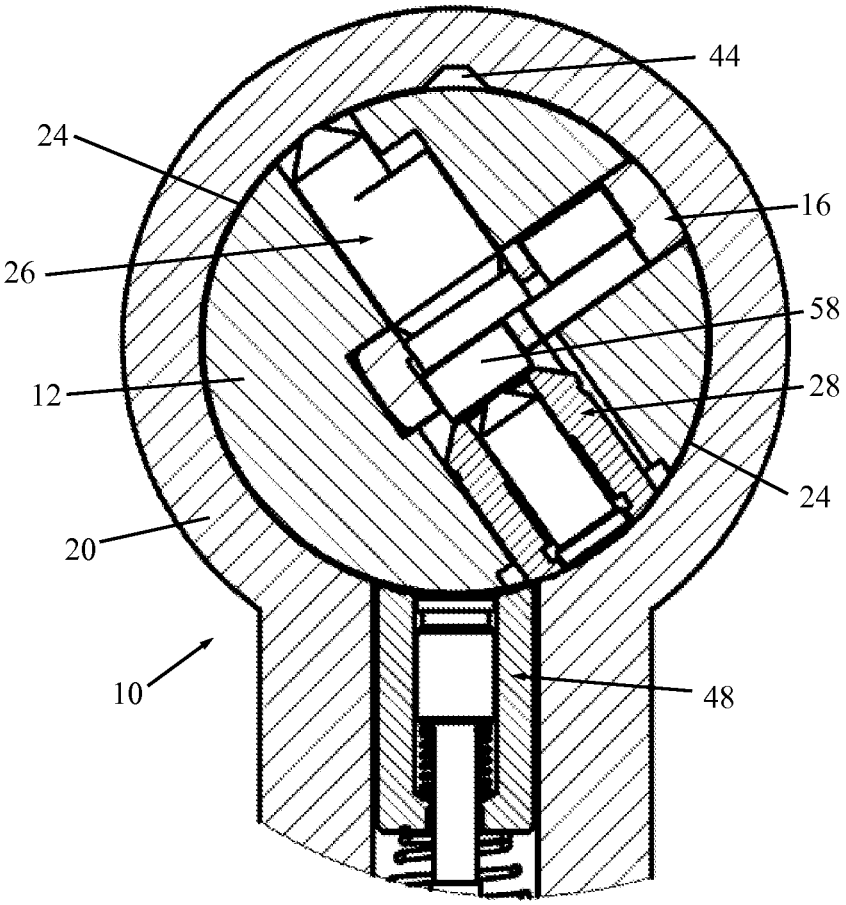

Reference is now made to FIG. 5. First movable element 26 has moved along shear line 24 away from recess 44, and second movable element 28 has moved along shear line 24 away from driver pin 48. Plug 12 turns freely along shear line 24.

It is noted that when key 16 is fully inserted in keyway 14 (i.e., cannot be inserted any further in keyway 14), the movable key combination element 58 protrudes beyond an outer surface of shaft portion 56 only upon movement of plug 12 in lock body 20. In prior art keys that are provided with a movable key combination element, the movable key combination element protrudes beyond the outer surface of the key shaft even before movement of the plug in the lock body, in response to touching a pin element in the plug.

The scope of the present invention includes both combinations and subcombinations of the features described hereinabove as well as modifications and variations thereof which would occur to a person of skill in the art upon reading the foregoing description and which are not in the prior art.

What is claimed is:

1. A lock assembly comprising:

a key comprising a shaft portion and at least one movable key combination element retained within said shaft portion; and a plug having a keyway for inserting therein said key, said plug arranged for movement in a bore formed in a lock body along a shear line defined between an outer perimeter of said plug and an inner perimeter of said bore, said plug comprising first and second movable elements located in openings formed in said plug on different sides of said keyway, wherein said first and second movable elements are not spring-loaded or biased by a biasing device located in said plug; and wherein when said key is fully inserted in said keyway, said at least one movable key combination element protrudes beyond an outer surface of said shaft portion only upon movement of said plug in said lock body.

2. The lock assembly according to claim 1, wherein a portion of said first movable element is received in a recess formed in said lock body and moves out of said recess upon the movement of said plug in said lock body.

3. The lock assembly according to claim 2, wherein said recess is relatively wide facing said plug and tapers to a narrower width in a direction away from said plug, said portion of said first movable element having a complementary-tapered shape to fit in said recess.

4. The lock assembly according to claim 1, wherein said first movable element comprises a base and a protrusion protruding from said base towards said shear line, and wherein a centerline of said base is offset from a centerline of said plug.

5. The lock assembly according to claim 2, wherein said opening in which said second movable element is disposed is formed with a counterbore facing said shear line and opposite to said recess.

6. The lock assembly according to claim 1, wherein said first and second movable elements touch opposite sides of said at least one movable key combination element when said key is inserted in said keyway.

7. The lock assembly according to claim 1, wherein said second movable element is arranged to move against a driver pin slidingly disposed in said lock body, said driver pin applying a biasing force towards said second movable element, and wherein said driver pin extends into said opening when said key is inserted in said keyway and moves out of said opening only upon said movement of said plug in said lock body.

8. The lock assembly according to claim 5, wherein said second movable element is arranged to move against a driver pin slidingly disposed in said lock body, said driver pin applying a biasing force towards said second movable element, and wherein said driver pin extends into said counterbore when said key is inserted in said keyway before said plug moves in said lock body, and wherein upon said movement of said plug in said lock body, said first movable element moves against said at least one movable key combination element, which moves against said second movable element, which moves against said driver pin, overcoming said biasing force and causing said driver pin to move out of said counterbore to permit rotation.

* * * * *